US007932707B2

(12) United States Patent
Imura

(10) Patent No.: US 7,932,707 B2
(45) Date of Patent: Apr. 26, 2011

(54) VOLTAGE REGULATOR WITH IMPROVED TRANSIENT RESPONSE

(75) Inventor: Takashi Imura, Chiba (JP)

(73) Assignee: Seiko Instruments Inc. (JP)

( * ) Notice: Subject to any disclaimer, the term of this patent is extended or adjusted under 35 U.S.C. 154(b) by 480 days.

(21) Appl. No.: 12/214,708

(22) Filed: Jun. 20, 2008

(65) Prior Publication Data

US 2009/0021231 A1 Jan. 22, 2009

(30) Foreign Application Priority Data

Jun. 21, 2007 (JP) ..... 2007-163279

(51) Int. Cl.
*G05F 1/575* (2006.01)

(52) U.S. Cl. ..... 323/280

(58) Field of Classification Search ..... 323/273, 323/280

See application file for complete search history.

(56) References Cited

U.S. PATENT DOCUMENTS

| | | | | |
|---|---|---|---|---|
| 6,060,871 | A * | 5/2000 | Barker | 323/280 |
| 6,933,772 | B1 * | 8/2005 | Banerjee et al. | 327/541 |
| 7,030,595 | B2 * | 4/2006 | Akita | 323/280 |
| 7,368,896 | B2 * | 5/2008 | Nagata et al. | 323/280 |
| 7,492,137 | B2 * | 2/2009 | Yamada | 323/280 |
| 2002/0171403 | A1 * | 11/2002 | Lopata | 323/280 |
| 2004/0104712 | A1 * | 6/2004 | Tanigawa et al. | 323/280 |
| 2007/0159146 | A1 * | 7/2007 | Mandal | 323/280 |
| 2009/0021231 | A1 * | 1/2009 | Imura | 323/282 |
| 2010/0148735 | A1 * | 6/2010 | Napravnik | 323/280 |
| 2010/0289464 | A1 * | 11/2010 | Yamamoto et al. | 323/280 |

* cited by examiner

*Primary Examiner* — Jeffrey L Sterrett
(74) *Attorney, Agent, or Firm* — Adams & Wilks

(57) ABSTRACT

Provided is a voltage regulator having satisfactory transient response characteristics. Because a PMOS (25) and an NMOS (24) pass drain currents (charge and discharge currents with respect to gate of PMOS (26)) based on the square of voltage (ΔIR) according to change (ΔI) in drain currents of NMOSs (16 and 17), a maximum value (Imax) of the charge and discharge currents becomes larger, transition time (t) of gate voltage of the PMOS (26) becomes shorter, and the transient response characteristics of the voltage regulator become better.

3 Claims, 5 Drawing Sheets

VOLTAGE REGULATOR WITH IMPROVED TRANSIENT RESPONSE

BACKGROUND OF THE INVENTION

1. Field of the Invention

The present invention relates to a voltage regulator.

2. Description of the Related Art

A conventional voltage regulator is described. FIG. 4 is a circuit diagram illustrating a conventional voltage regulator.

NMOSs 46 and 47, PMOSs 48 and 49, NMOSs 53 and 54, a PMOS 52, and a PMOS 55 form a differential amplifier circuit. In the differential amplifier circuit, gates of the NMOSs 46 and 47 are input terminals while drains of the PMOS 55 and the NMOS 54 are output terminals. The PMOS 55 and NMOS 54 form a push-pull circuit. NMOSs 44 and 45 form a current mirror circuit and have constant current characteristics. A constant current circuit 58 and the NMOSs 44 and 45 function as a current supply means to the differential amplifier circuit.

Input voltage Vin which is power supply voltage is input to an input terminal 42. A PMOS 56 outputs to an output terminal 43 output voltage Vout which is controlled to be predetermined constant voltage based on the input voltage Vin and output voltage of the differential amplifier circuit. The output terminal 43 outputs the output voltage Vout which is controlled to be the predetermined constant voltage. The output voltage Vout of the output terminal 43 is input to a voltage divider circuit 57. The voltage divider circuit 57 divides the output voltage Vout and outputs divided voltage Vfb. The constant current circuit 58 supplies constant current Ibias to the differential amplifier circuit. A reference voltage circuit 59 applies reference voltage Vref to the gate of the NMOS 46. The reference voltage Vref and the divided voltage Vfb are input to the differential amplifier circuit. The differential amplifier circuit amplifies differential voltage Vdiff between the reference voltage Vref and the divided voltage Vfb, and outputs the output voltage Vout based on the differential voltage Vdiff. The differential amplifier circuit controls the output voltage Vout to be the predetermined constant voltage by controlling gate voltage of the PMOS 56 such that the reference voltage Vref and the divided voltage Vfb are equal to each other (see, for example, Japanese Patent Application Laid-open No. 2001-273042).

Here, characteristics of the PMOSs 48 and 49, the PMOS 52, and the PMOS 55 are the same, characteristics of the NMOSs 46 and 47 are the same, and a mirror ratio of the current mirror circuit of the NMOSs 53 and 54 is 1:1.

When the differential voltage Vdiff between the reference voltage Vref and the divided voltage Vfb is 0, gate voltage of the NMOS 46 and gate voltage of the NMOS 47 are the same, and drain current of the NMOS 46 and drain current of the NMOS 47 are the same. Therefore, the values of those drain currents and of drain currents of the PMOSs 48 and 49, the PMOS 52, and the PMOS 55 are the same, and values of drain currents of the NMOSs 53 and 54 are the same. Each drain current is half of drain current Itail of the NMOS 45.

Next, the drain currents of the respective transistors are described. FIGS. 5A and 5B are graphs illustrating the drain currents of the respective conventional transistors.

FIG. 5A illustrates a relationship between the differential voltage Vdiff and absolute values of the drain currents of the NMOSs 46 and 47 which are transistors in an input stage of the differential amplifier circuit. When the differential voltage Vdiff is 0, the values of the drain currents of the NMOSs 46 and 47 are the same, and each of the drain currents is half of the drain current Itail of the NMOS 45. When the differential voltage Vdiff varies, the absolute value of the drain current of one of the NMOSs 46 and 47 increases, and the absolute value of the drain current of the other MOS decreases accordingly.

FIG. 5B illustrates a relationship between the differential voltage Vdiff and absolute values of the drain currents of the PMOS 55 and the NMOS 54 (absolute values of charge and discharge currents with respect to a gate of the PMOS 56 which is an output transistor). When the differential voltage Vdiff is 0, the values of the drain currents of the PMOS 55 and the NMOS 54 are the same, and each of the drain currents is half of the drain current Itail of the NMOS 45.

When the differential voltage Vdiff varies, the absolute value of the drain current of one of the PMOS 55 and the NMOS 54 increases, and the absolute value of the drain current of the other MOS decreases accordingly. A maximum value Imax of the drain currents (charge and discharge currents with respect to gate of PMOS 56) is the value of the drain current Itail of the NMOS 45.

Power consumption of electronic equipment such as portable electronic equipment is sometimes reduced by switching an electronic circuit therein between two states: a standby state for operation with reduced power consumption; and a normal operation state other than the standby state. In such a case, power consumption of a voltage regulator for supplying power supply voltage to the electronic equipment may also be reduced.

However, in an ordinary voltage regulator, reduced power consumption results in inferior transient response characteristics.

SUMMARY OF THE INVENTION

The present invention has been made in view of the above problem, and an object of the present invention is to provide a voltage regulator having satisfactory transient response characteristics.

In order to solve the above problem, according to an aspect of the present invention, a voltage regulator is provided, the voltage regulator including: an input terminal to which input voltage is input; an output transistor for outputting to an output terminal output voltage controlled to be predetermined constant voltage based on the input voltage and output voltage of a differential amplifier circuit; the output terminal for outputting the output voltage; a voltage divider circuit to which the output voltage is input for dividing the output voltage and outputting divided voltage; a constant current circuit for supplying a constant current to the differential amplifier circuit; a reference voltage circuit for generating reference voltage; and the differential amplifier circuit having an input stage including transistors to which the reference voltage and the divided voltage are input, for passing charge and discharge currents with respect to a gate of the output transistor based on the square of voltage according to change in drain currents of the transistors in the input stage and controlling gate voltage of the output transistor such that the reference voltage and the divided voltage are equal to each other, thereby controlling the output voltage to be equal to the predetermined constant voltage.

According to the present invention, because the differential amplifier circuit passes the charge and discharge currents with respect to the gate of the output transistor based on the square of the voltage according to change in drain currents of the transistors in the input stage, a maximum value of the charge and discharge currents becomes larger, transition time of the gate voltage of the output transistor becomes shorter, and transient response characteristics of the voltage regulator become better.

DETAILED DESCRIPTION OF THE PREFERRED EMBODIMENT

An embodiment of the present invention is described in the following with reference to the attached drawings.

Figure 1:
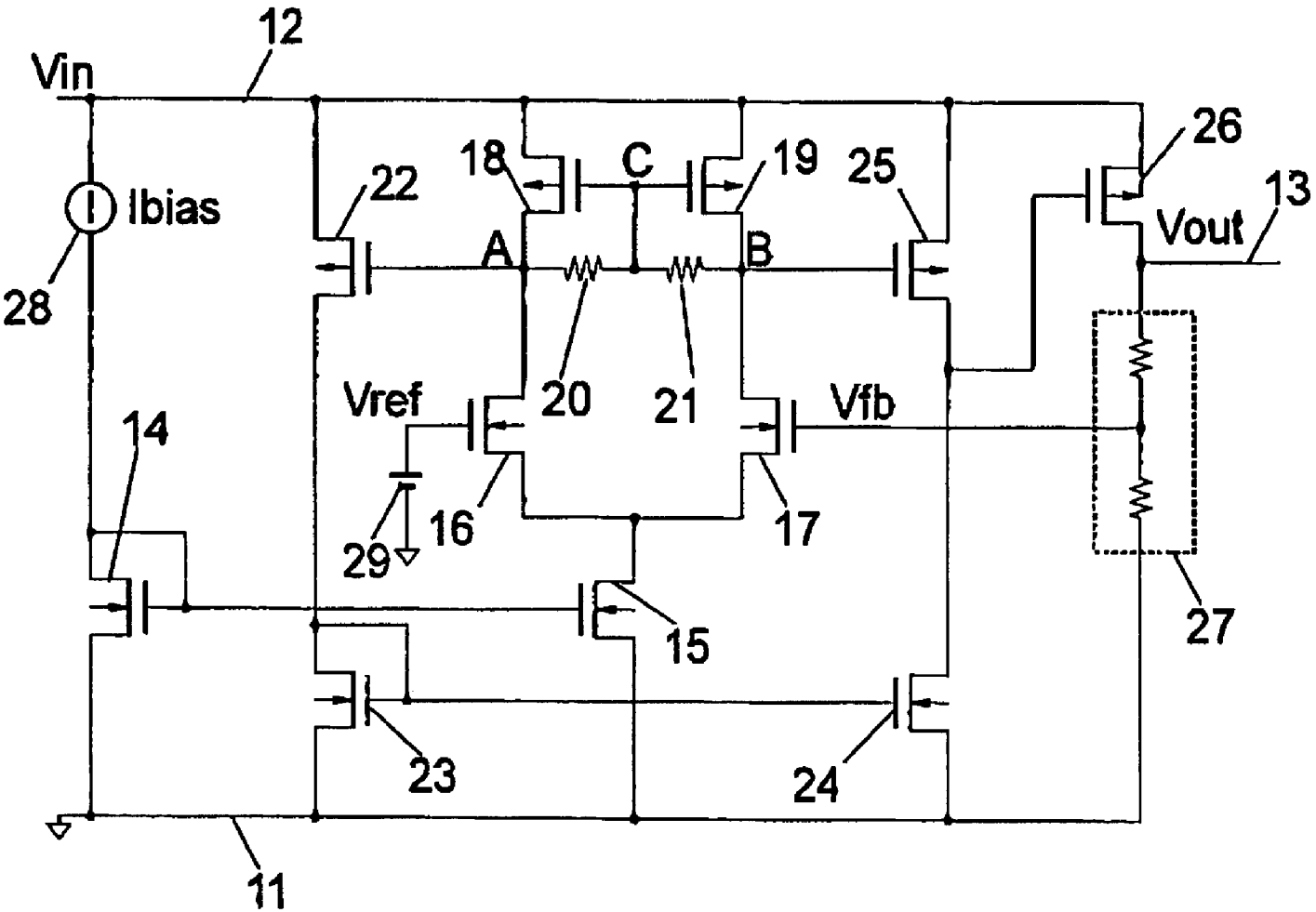
FIG. 1 is a circuit diagram illustrating a voltage regulator.

First, a structure of a voltage regulator is described. FIG. 1 is a circuit diagram illustrating the voltage regulator.

The voltage regulator has a ground terminal 11, an input terminal 12, an output terminal 13, NMOSs 14 to 17, resistances 20 and 21, NMOSs 23 and 24, PMOSs 18 and 19, a PMOS 22, PMOSs 25 and 26, a voltage divider circuit 27, a constant current circuit 28, and a reference voltage circuit 29.

The constant current circuit 28 is provided between the input terminal 12 and a drain of the NMOS 14. A source of the NMOS 14 is connected to the ground terminal 11 while a gate of the NMOS 14 is connected to the drain of the NMOS 14 and a gate of the NMOS 15. A source of the NMOS 15 is connected to the ground terminal 11 while a drain of the NMOS 15 is connected to sources of the NMOSs 16 and 17. The reference voltage circuit 29 is provided between the ground terminal 11 and a gate of the NMOS 16. A drain of the NMOS 16 is connected to a drain of the PMOS 18. A gate of the NMOS 17 is connected to the voltage divider circuit 27 while a drain of the NMOS 17 is connected to a drain of the PMOS 19. A gate of the PMOS 18 is connected to a gate of the PMOS 19 while a source of the PMOS 18 is connected to the input terminal 12. A source of the PMOS 19 is connected to the input terminal 12. A resistance 20 is provided between the gate and the drain of the PMOS 18 while a resistance 21 is provided between the gate and the drain of the PMOS 19.

A gate of the PMOS 22 is connected to the drain of the PMOS 18, a source of the PMOS 22 is connected to the input terminal 12, and a drain of the PMOS 22 is connected to a drain of the NMOS 23. A gate of the NMOS 23 is connected to a gate of the NMOS 24, a source of the NMOS 23 is connected to the ground terminal 11, and the drain of the NMOS 23 is connected to the gate of the NMOS 23. A source of the NMOS 24 is connected to the ground terminal 11 and a drain of the NMOS 24 is connected to a drain of the PMOS 25. A gate of the PMOS 25 is connected to the drain of the PMOS 19 and a source of the PMOS 25 is connected to the input terminal 12. The voltage divider circuit 27 is provided between the output terminal 13 and the ground terminal 11. A gate of the PMOS 26 is connected to the drain of the PMOS 25, a source of the PMOS 26 is connected to the input terminal 12, and a drain of the PMOS 26 is connected to the output terminal 13.

The NMOSs 16 and 17, the PMOSs 18 and 19, the resistances 20 and 21, the NMOSs 23 and 24, the PMOS 22 and the PMOS 25 form a differential amplifier circuit. In the differential amplifier circuit, the gates of the NMOSs 16 and 17 are input terminals and the drains of the PMOS 25 and the NMOS 24 are output terminals. The PMOS 25 and the NMOS 24 form a push-pull circuit. The NMOSs 14 and 15 form a current mirror circuit and have constant current characteristics. The constant current circuit 28 and the NMOSs 14 and 15 function as a current supply means to the differential amplifier circuit.

Input voltage Vin which is power supply voltage is input to the input terminal 12. The PMOS 26 which is an output transistor outputs to the output terminal 13 the output voltage Vout controlled to be predetermined constant voltage based on the input voltage Vin and the output voltage of the differential amplifier circuit. The output terminal 13 outputs the output voltage Vout. The output voltage Vout of the output terminal 13 is input to the voltage divider circuit 27. The voltage divider circuit 27 divides the output voltage Vout, and outputs divided voltage Vfb. The constant current circuit 28 supplies constant current Ibias to the differential amplifier circuit. The reference voltage circuit 29 generates reference voltage Vref, and applies the reference voltage Vref to the gate of the NMOS 16. The reference voltage Vref and the divided voltage Vfb are input to transistors in an input stage of the differential amplifier circuit. The differential amplifier circuit amplifies differential voltage Vdiff between the reference voltage Vref and the divided voltage Vfb, and outputs to the gate of the PMOS 26 output voltage based on the differential voltage Vdiff. The differential amplifier circuit controls the output voltage Vout to be the predetermined constant voltage by controlling gate voltage of the PMOS 26 such that the reference voltage Vref and the divided voltage Vfb are equal to each other.

Next, an operation of the voltage regulator is described.

Here, characteristics of the PMOSs 18 and 19, the PMOS 22, and the PMOS 25 are the same, characteristics of the NMOSs 16 and 17 are the same, and a mirror ratio of the current mirror circuit of the NMOSs 23 and 24 is 1:1.

When the differential voltage Vdiff between the reference voltage Vref and the divided voltage Vfb is 0, gate voltage of the NMOS 16 and gate voltage of the NMOS 17 are the same, and drain current of the NMOS 16 and drain current of the NMOS 17 are the same. Because of the current mirror circuit, drain current of the PMOS 18 and drain current of the PMOS 19 are the same. Each drain current is half of drain current Itail of the NMOS 15. Because voltage at a node A and voltage at a node B are the same, current does not pass through the resistances 20 and 21 between the node A and the node B. Therefore, the voltage at the node A, the voltage at the node B, and voltage at a node C are equal to one another. Here, gate-source voltages of the PMOSs 18 and 19, the PMOS 22, and the PMOS 25 are the same, and drain currents of the PMOSs 18 and 19, the PMOS 22, and the PMOS 25 are the same. Because current Itail/2 passes through the PMOSs 18 and 19, the PMOS 22, and the PMOS 25, the differential amplifier circuit passes current 2Itail.

When output current transiently varies and the output voltage Vout becomes lower than the predetermined constant voltage, the gate voltage of the NMOS 17 becomes lower than the gate voltage of the NMOS 16, and the drain current of the NMOS 17 becomes smaller than the drain current of the NMOS 16 by 2ΔI. Here, the drain current of the NMOS 17 becomes smaller by ΔI while the drain current of the NMOS 16 becomes larger by ΔI. Because the values of the resistances 20 and 21 are the same, the voltage at the node C does not vary and gate voltages of the PMOSs 18 and 19 do not vary, and thus, the drain currents of the PMOSs 18 and 19 do not vary. Further, because of the current mirror circuit, the drain currents of the PMOSs 18 and 19 are the same. Therefore, the above-mentioned current 2ΔI passes from the node B to the node A. When the value of the resistances 20 and 21 is denoted by a resistance value R, because voltage drops across the resistances 20 and 21, the voltage at the node B becomes higher by ΔIR, the gate-source voltage of the PMOS 25 becomes lower by ΔIR, the voltage at the node A becomes lower by ΔIR, and the gate-source voltage of the PMOS 22 becomes higher by ΔIR. Here, the PMOS 22 and the PMOS 25 operate in a saturation region, and the drain current of the PMOS 22 and the drain current of the PMOS 25 are in proportion to the square of the respective gate-source voltages. Therefore, the drain current of the PMOS 25 decreases in proportion to the square of ΔIR, and the drain currents of the PMOS 22 and the NMOSs 23 and 24 increase in proportion to the square of ΔIR. The drain current of the PMOS 22 effects push-pull operation of the PMOS 25 and the NMOS 24 via the current mirror circuit of the NMOSs 23 and 24. Therefore, drain voltage of the PMOS 25, drain voltage of the NMOS 24, and the gate voltage of the PMOS 26 become lower, drain current (output current) of the PMOS 26 increases, and the output voltage Vout becomes higher.

When the output current transiently varies and the output voltage Vout becomes higher than the predetermined constant voltage, the gate voltage of the NMOS 17 becomes higher than the gate voltage of the NMOS 16, and the drain current of the NMOS 17 becomes larger than the drain current of the NMOS 16 by 2ΔI. The above-mentioned current 2ΔI passes from the node A to the node B. The voltage at the node B becomes lower by ΔIR, the gate-source voltage of the PMOS 25 becomes higher by ΔIR, the voltage at the node A becomes higher by ΔIR, and the gate-source voltage of the PMOS 22 becomes lower by ΔIR. The drain current of the PMOS 25 increases in proportion to the square of ΔIR, and the drain currents of the PMOS 22 and the NMOSs 23 and 24 decrease in proportion to the square of ΔIR. Therefore, the drain voltage of the PMOS 25, the drain voltage of the NMOS 24, and the gate voltage of the PMOS 26 become higher, the drain current (output current) of the PMOS 26 decreases, and the output voltage Vout becomes lower.

Figures 2A, 2B:
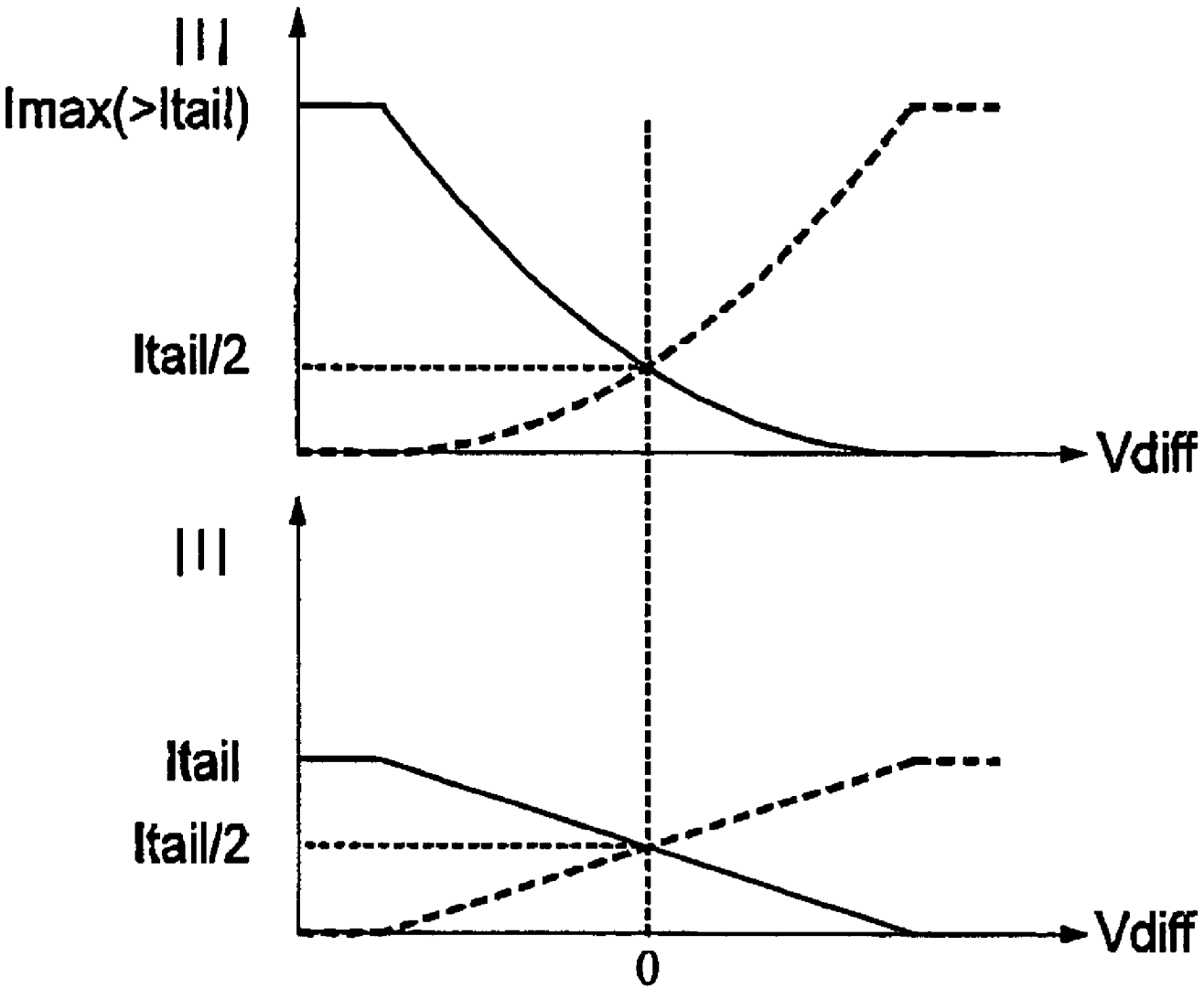
FIGS. 2A and 2B are graphs illustrating drain currents of respective transistors.

Next, the drain currents of the respective transistors are described. FIGS. 2A and 2B are graphs illustrating the drain currents of the respective transistors.

FIG. 2A illustrates a relationship between the differential voltage Vdiff and absolute values of the drain currents of the NMOSs 16 and 17 which are transistors in the input stage of the differential amplifier circuit. When the differential voltage Vdiff is 0, the values of the drain currents of the NMOSs 16 and 17 are the same, and each of the drain currents is half of the drain current Itail of the NMOS 15. When the differential voltage Vdiff varies, the absolute value of the drain current of one of the NMOSs 16 and 17 increases, and the absolute value of the drain current of the other MOS decreases accordingly.

FIG. 2B illustrates a relationship between the differential voltage Vdiff and absolute values of the drain currents of the PMOS 25 and the NMOS 24 (absolute values of charge and discharge currents with respect to the gate of the PMOS 26 which is an output transistor). When the differential voltage Vdiff is 0, the values of the drain currents of the PMOS 25 and the NMOS 24 are the same, and each of the drain currents is half of the drain current Itail of the NMOS 15. When the differential voltage Vdiff varies, the absolute value of the drain current of one of the PMOS 25 and the NMOS 24 increases, and the absolute value of the drain current of the other MOS decreases accordingly. A maximum value Imax of the drain current (charge and discharge currents with respect to gate of PMOS 26) is larger than the value of the drain current Itail of the NMOS 15.

Because a relatively large gate parasitic capacitance exists in the gate of the PMOS 26, it takes predetermined transition time for transition of the gate voltage. When a transition width of the gate voltage is denoted by ΔVg, the gate parasitic capacitance is denoted by Cg, and the maximum value of the charge and discharge currents with respect to the gate is denoted by Imax, transition time t of the gate voltage is calculated by the following equation:

$$t=\Delta Vg\times Cg/\mathrm{Imax}$$

Because the transition width ΔVg of the gate voltage is determined by the width of variation of the output current and the output voltage Vout and the gate parasitic capacitance Cg is determined by driving ability of the PMOS 26 and the thickness of a gate insulating film, when the maximum value Imax of the charge and discharge currents with respect to the gate becomes larger, the transition time t of the gate voltage becomes shorter, and transient response characteristics of the voltage regulator become better.

Because, in this way, the PMOS 25 and the NMOS 24 pass the drain current (charge and discharge currents with respect to gate of PMOS 26) based on the square of the voltage (ΔIR) according to the change (ΔI) in drain currents of the NMOSs 16 and 17, the maximum value Imax of the charge and discharge currents becomes larger, the transition time t of the gate voltage of the PMOS 26 becomes shorter, and the transient response characteristics of the voltage regulator become better. Then, in transition where the state of a load transitions, even when the output current transiently varies, the voltage regulator having the satisfactory transient response characteristics can operate normally, and the output voltage Vout of the voltage regulator is the predetermined constant voltage.

Further, because the transient response characteristics of the voltage regulator become better, the power consumption may be suppressed accordingly.

Figure 3:
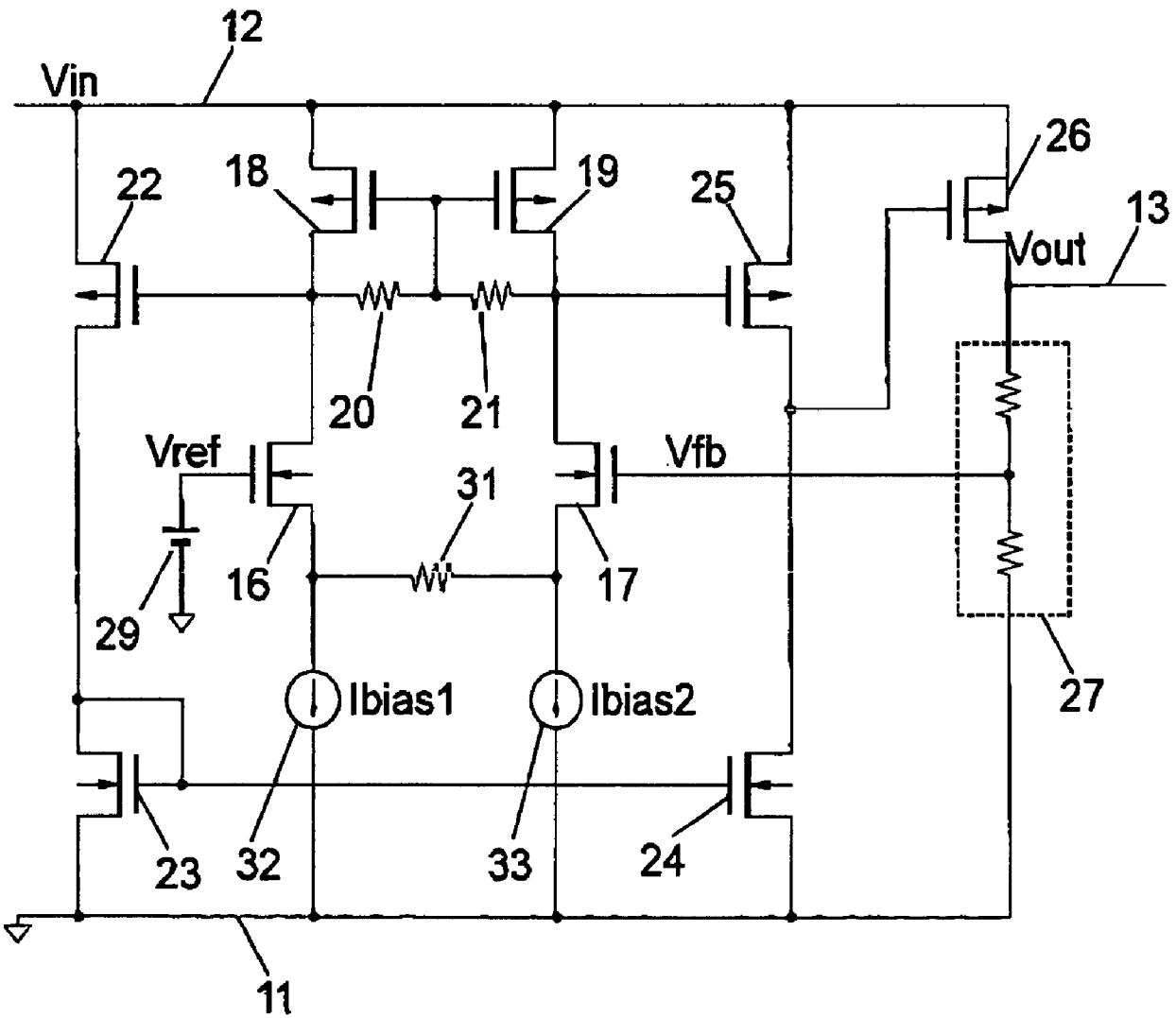
FIG. 3 is a circuit diagram illustrating a voltage regulator.
Figure 4:
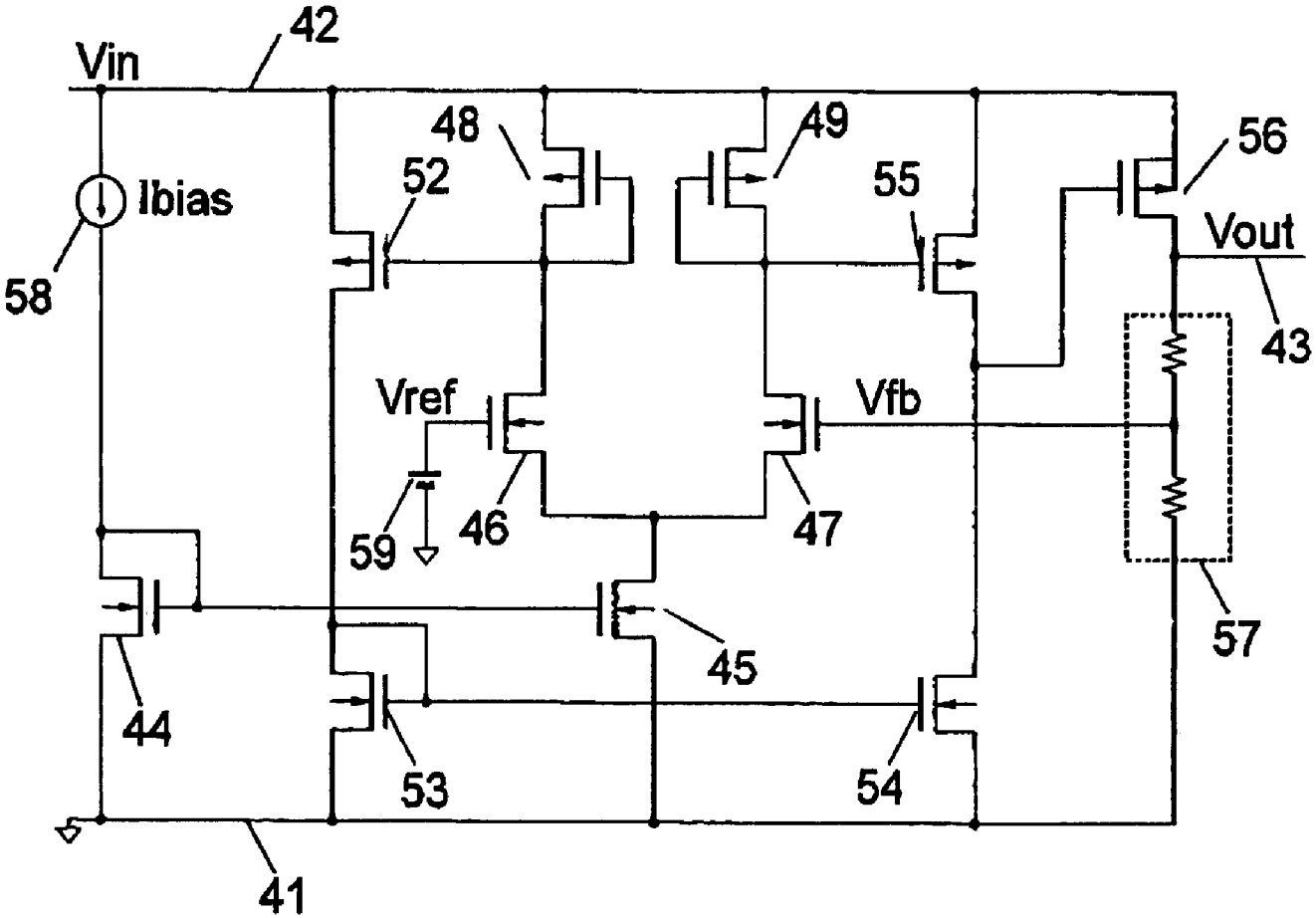
FIG. 4 PRIOR ART
FIG. 4 is a circuit diagram illustrating a conventional voltage regulator.
Figures 5A, 5B:
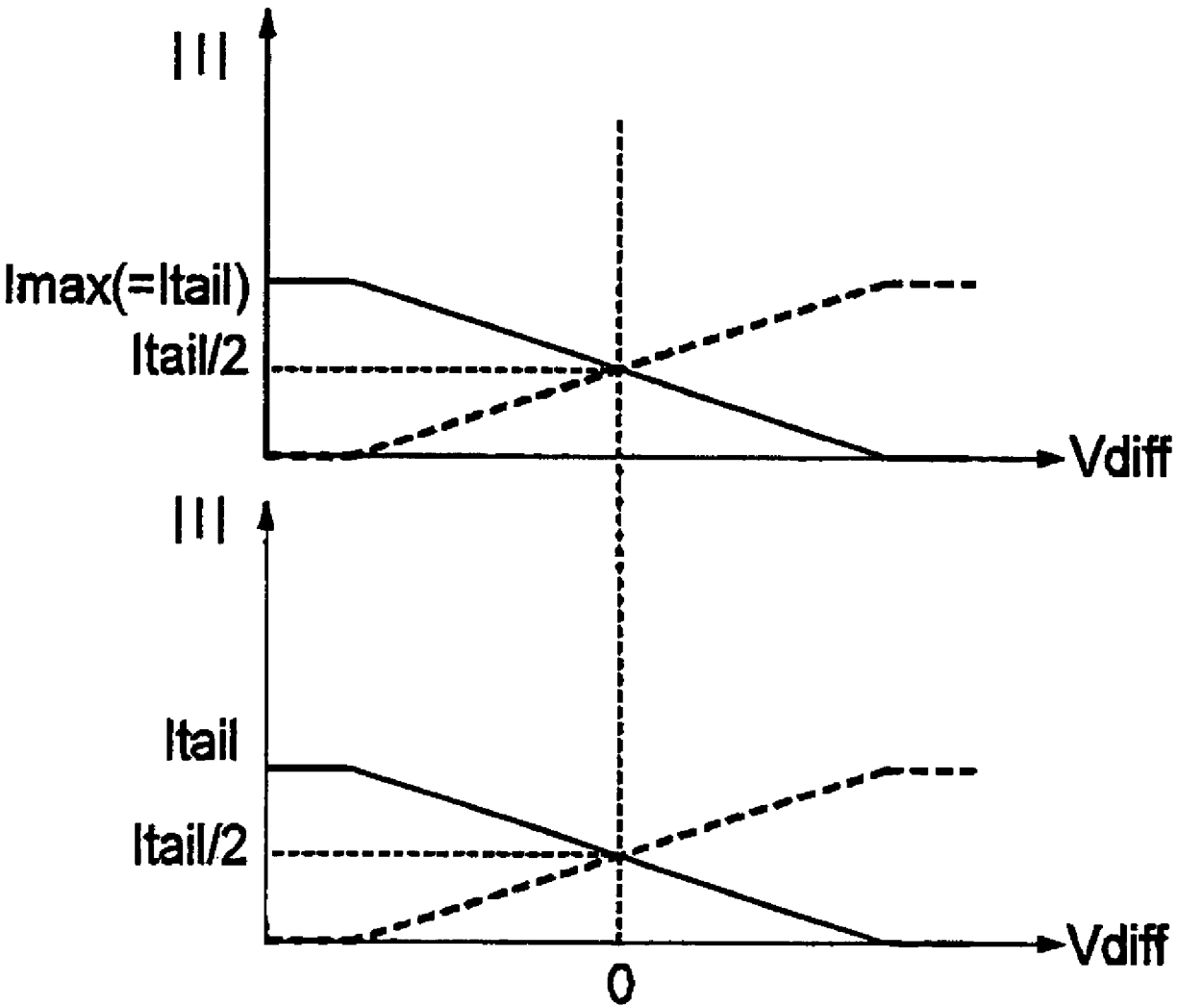
FIG. 5B PRIOR ART
FIG. 5A PRIOR ART
FIGS. 5A and 5B are graphs illustrating drain currents of respective conventional transistors.

It is to be noted that, in FIG. 1, the constant current circuit and the NMOSs 14 and 15 are the current supply means to the differential amplifier circuit, but, as illustrated in FIG. 3, constant current circuits 32 and 33 and a resistance 31 may be the current supply means.

Further, the current mirror circuit of the NMOSs 23 and 24 may be a Wilson current mirror circuit or a cascode current mirror circuit with a transistor (not shown) added thereto.

What is claimed is:

1. A voltage regulator, comprising:

an input terminal to which input voltage is input;

an output terminal for outputting output voltage;

an output transistor provided between the input terminal and the output terminal;

a voltage divider circuit provided at the output terminal for dividing the output voltage and for outputting divided voltage;

a reference voltage circuit for outputting reference voltage; and a differential amplifier circuit including a first input transistor having a gate to which the reference voltage is input and a second input transistor having a gate to which the divided voltage is input, for controlling the output transistor based on a square of voltage according to change in drain currents of the input transistors.

2. A voltage regulator according to claim 1, wherein the differential amplifier circuit comprises:

a constant current circuit;

a first transistor of a first conductivity type having a gate connected to the reference voltage circuit and a source connected to the constant current circuit;

a second transistor of the first conductivity type having a gate connected to the voltage divider circuit and a source connected to the constant current circuit;

a first transistor of a second conductivity type having a source connected to the input terminal and a drain connected to a drain of the first transistor of the first conductivity type;

a second transistor of the second conductivity type having a gate connected to a gate of the first transistor of the second conductivity type, a source connected to the input terminal, and a drain connected to a drain of the second transistor of the first conductivity type;

a first resistance having one end connected to the gate of the first transistor of the second conductivity type and another end connected to the drain of the first transistor of the second conductivity type;

a second resistance having one end connected to the gate of the second transistor of the second conductivity type and another end connected to the drain of the second transistor of the second conductivity type;

a third transistor of the second conductivity type having a gate connected to the another end of the first resistance and a source connected to the input terminal;

a third transistor of the first conductivity type having a gate, a source connected to a ground terminal, and a drain connected to a drain of the third transistor of the second conductivity type and the gate;

a fourth transistor of the first conductivity type having a gate connected to the gate of the third transistor of the first conductivity type, a source connected to the ground terminal, and a drain connected to a gate of the output transistor; and a fourth transistor of the second conductivity type having a gate connected to the another end of the second resistance, a source connected to the input terminal, and a drain connected to the gate of the output transistor.

3. A voltage regulator according to claim 1, wherein the differential amplifier circuit comprises:

a constant current circuit;

a first transistor of a first conductivity type having a gate connected to the reference voltage circuit and a source connected to the constant current circuit;

a second transistor of the first conductivity type having a gate connected to the voltage divider circuit and a source connected to the constant current circuit;

a first transistor of a second conductivity type having a source connected to the input terminal and a drain connected to a drain of the first transistor of the first conductivity type;

a second transistor of the second conductivity type having a gate connected to a gate of the first transistor of the second conductivity type, a source connected to the input terminal, and a drain connected to a drain of the second transistor of the first conductivity type;

a first resistance having one end connected to the gate of the first transistor of the second conductivity type and another end connected to the drain of the first transistor of the second conductivity type;

a second resistance having one end connected to the gate of the second transistor of the second conductivity type and another end connected to the drain of the second transistor of the second conductivity type;

a third transistor of the second conductivity type having a gate connected to another end of the first resistance and a source connected to the input terminal;

a current mirror circuit having two terminals, one of the two terminals passing a current-mirror current based on drain current of the third transistor of the second conductivity type, another one of the two terminals passing a current, based on the current-mirror current, to a gate of the output transistor; and a fourth transistor of the second conductivity type having a gate connected to the another end of the second resistance, a source connected to the input terminal, and a drain connected to the gate of the output transistor.

* * * * *